US009182715B1

(12) United States Patent
Ueno et al.

(10) Patent No.: US 9,182,715 B1
(45) Date of Patent: Nov. 10, 2015

(54) FIXING DEVICE AND IMAGE FORMING APPARATUS

(71) Applicant: FUJI XEROX CO., LTD., Tokyo (JP)

(72) Inventors: Tomohiro Ueno, Kanagawa (JP); Takayuki Uchiyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/606,506

(22) Filed: Jan. 27, 2015

(30) Foreign Application Priority Data

Sep. 26, 2014 (JP) ..... 2014-197279

(51) Int. Cl.
*G03G 15/20* (2006.01)

(52) U.S. Cl.
CPC ..... *G03G 15/2064* (2013.01); *G03G 15/2032* (2013.01); *G03G 15/2067* (2013.01)

(58) Field of Classification Search
CPC ..... G03G 15/2032; G03G 15/2035; G03G 15/2064; G03G 15/2067; G03G 15/2071
USPC ..... 399/331, 320, 328, 329, 122
See application file for complete search history.

(56) References Cited

U.S. PATENT DOCUMENTS

| | | | | |
|---|---|---|---|---|
| 2009/0226211 | A1* | 9/2009 | Gotoh et al. | 399/122 |
| 2010/0086333 | A1* | 4/2010 | Kim | 399/328 |
| 2010/0202808 | A1* | 8/2010 | Russel et al. | 399/328 |
| 2011/0142507 | A1* | 6/2011 | Sasaki et al. | 399/331 |

FOREIGN PATENT DOCUMENTS

| | | | |
|---|---|---|---|
| JP | 10-181937 | A | 7/1998 |
| JP | 2009-98169 | A | 5/2009 |

* cited by examiner

*Primary Examiner* — Sophia S Chen
(74) *Attorney, Agent, or Firm* — Sughrue Mion, PLLC

(57) ABSTRACT

A fixing device includes a rotatable fixing member, a rotatable pressure member having one and the other end portions in the axial direction, a first cam, a connecting member, and a second cam. The fixing member is used to fix an image. The pressure member is pressed against the fixing member. The first cam attached to the one end portion of the pressure member is rotated in one direction to apply a pressure toward the fixing member. The connecting member is connected to the first cam and the second cam. The second cam attached to the other end portion of the pressure member is rotated in the one direction to apply a pressure toward the fixing member. Before the first and second cams are rotated, a projecting portion of the second cam is positioned downstream of a projecting portion of the first cam in the one direction.

6 Claims, 5 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2014-197279 filed Sep. 26, 2014.

BACKGROUND

Technical Field

The present invention relates to a fixing device and an image forming apparatus.

SUMMARY

A fixing device according to an aspect of the present invention includes a fixing member, a pressure member, a first cam, a connecting member, and a second cam. The fixing member is used to fix an image onto a recording medium. The pressure member has one end portion and another end portion in an axial direction thereof, is rotatably provided, and is pressed against the fixing member so as to apply a pressure to the recording medium. The first cam has an outer circumferential surface and a projecting portion provided on the outer circumferential surface of the first cam. The first cam is attached to the one end portion of the pressure member, is rotatable in a circumferential direction of the pressure member, and is rotated in one direction so as to cause the projecting portion thereof to apply a pressure toward the fixing member, thereby causing the one end portion side of the pressure member to move in a direction in which the one end portion side of the pressure member is separated from the fixing member. The connecting member is connected to the first cam on the one end portion side of the pressure member and extends toward the other end portion side of the pressure member. The second cam has an outer circumferential surface and a projecting portion provided on the outer circumferential surface of the second cam. The second cam is attached to the other end portion of the pressure member. The connecting member is connected to the second cam. The second cam is rotatable in the circumferential direction of the pressure member. The second cam is rotated in the one direction by receiving a drive force from the connecting member, which is interlocked with the first cam rotated in the one direction, so as to cause the projecting portion thereof to apply a pressure toward the fixing member, thereby causing the other end portion side of the pressure member to move in a direction in which the other end portion side of the pressure member is separated from the fixing member. In the fixing device, before the first cam and the second cam are rotated in the one direction, the projecting portion of the second cam is positioned downstream of the projecting portion of the first cam in the one direction.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described in detail below with reference to the accompanying drawings.

Figure 1:
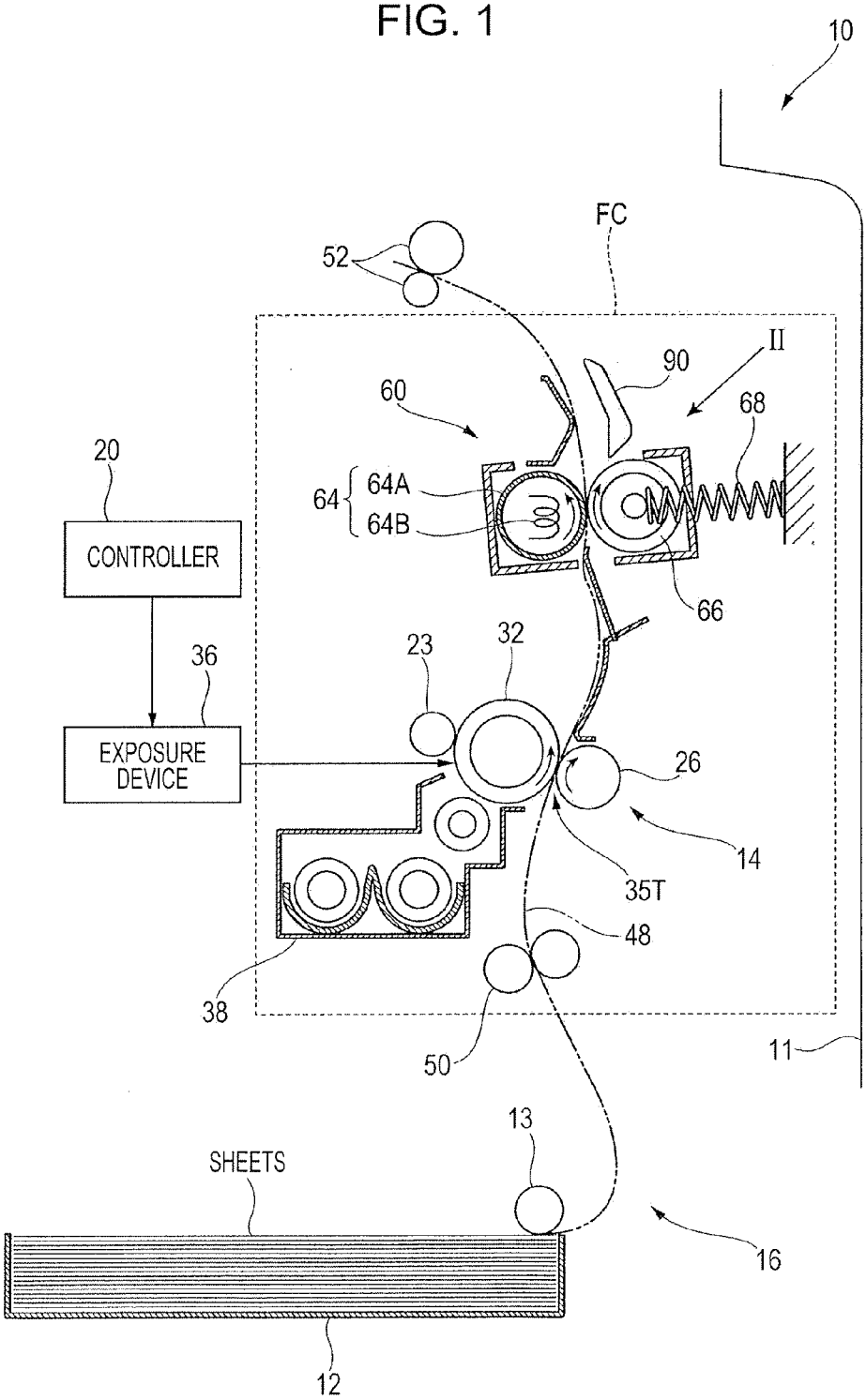
FIG. 1 is a schematic view illustrating the structure of an image forming apparatus according to an exemplary embodiment.

FIG. 1 is a schematic view illustrating the structure of an image forming apparatus 10 according to the present exemplary embodiment.

The image forming apparatus 10 is provided with a housing 11. A container 12, an image forming section 14, a sheet transport mechanism 16, and a controller 20 are provided in the housing 11. The container 12 contains a sheet of paper or sheets of paper. The sheet or each of the sheets (hereafter referred to in the singular form as the "sheet" except for when use of the plural form is necessary) serves as an example of a recording medium. The image forming section 14 forms an image on the sheet. The sheet transport mechanism 16 transports the sheet from the container 12 to the image forming section 14. The controller 20 controls operations of the components of the image forming apparatus 10. Furthermore, a sheet stacking unit (not illustrated) is provided on an upper side of the housing 11. The sheet on which an image has been formed is placed in the sheet stacking unit.

A photoconductor drum 32, which is rotated counterclockwise in FIG. 1, is provided in the image forming section 14. Furthermore, a transfer roller 26, which is rotated clockwise in FIG. 1 so as to transfer a toner image held by the photoconductor drum 32 onto the sheet, is provided.

Furthermore, a charging roller 23, which charges the photoconductor drum 32, is provided near the photoconductor drum 32. Furthermore, an exposure device 36 is provided. The exposure device 36 forms an electrostatic latent image on the photoconductor drum 32 by causing the photoconductor drum 32 to be exposed to light in accordance with image data from the controller 20. Furthermore, a developing device 38 is provided. The developing device 38 develops the electrostatic latent image having been formed by the exposure device 36 so as to form a toner image on the photoconductor drum 32.

The sheet transport mechanism 16 is provided with a sheet passage 48 through which the sheet passes. The sheet transport mechanism 16 is also provided with transport rollers 50 along the sheet passage 48 so as to transport the sheet. Although only a pair of the transport rollers 50 are illustrated in FIG. 1, plural pairs of the transport rollers 50 are provided.

Furthermore, a fixing device 60, which fixes a toner image having been transferred onto the sheet, is provided above a transfer portion 35T in FIG. 1 (downstream of the transfer portion 35T in a transport direction of the sheet). The transfer portion 35T is formed by the photoconductor drum 32 and the transfer roller 26. Furthermore, transport rollers 52 are provided above the fixing device 60 in FIG. 1. The transport rollers 52 transport the sheet onto which the toner image have been fixed to the sheet stacking unit (not illustrated).

Next, a flow of processes performed by the image forming apparatus 10 is described.

In the image forming apparatus 10 according to the present exemplary embodiment, a topmost one of the sheets contained in the container 12 is initially fed onto the sheet passage 48 by a feed roller 13. Next, this sheet is transported to the transfer portion 35T by the transport rollers 50 provided along the sheet passage 48.

Meanwhile, in the image forming section 14, the photoconductor drum 32 is charged by the charging roller 23 and the photoconductor drum 32 is exposed to the light by the exposure device 36. Thus, an electrostatic latent image is formed on the photoconductor drum 32. Next, the electrostatic latent image is developed by the developing device 38, thereby a toner image is formed on the photoconductor drum 32.

This toner image is transferred onto the sheet by the transfer roller 26 in the transfer portion 35T. After that, the sheet is transported to the fixing device 60 and subjected to a heating process and a pressure applying process in the fixing device 60. The sheet having passed through the fixing device 60 is placed in the sheet stacking unit (not illustrated).

Next, the structure of the fixing device 60 is described.

As illustrated in FIG. 1, the fixing device 60 according to the present exemplary embodiment includes a heating roller 64, which serves as an example of a fixing member used for fixing a toner image onto the sheet. Furthermore, the fixing device 60 includes a rotatable pressure roller 66, which serves as an example of a pressure member, which is pressed against the heating roller 64 so as to apply pressure on the sheet positioned therebetween.

The heating roller 64, which is rotatably provided, includes a cylindrical member 64A and a heat source 64B. The cylindrical member 64A is formed of a metal material such as aluminum. The heat source 64B, which uses, for example, a halogen lamp, is provided in the cylindrical member 64A.

The pressure roller 66 includes, for example, a cylindrical base member and an elastic member disposed on an outer circumferential surface of the base member.

Furthermore, in the present exemplary embodiment, two spring members 68 are provided such that the spring members 68 correspond to respective end portions of the pressure roller 66 in the axial direction of the pressure roller 66. The end portions of the pressure roller 66 are pressed toward the heating roller 64 by these spring members 68, thereby the pressure roller 66 is pressed against the heating roller 64.

Also in the present exemplary embodiment the pressure roller 66 is separated from the heating roller 64 by user (operator) operation performed on an operating lever, which will be described later. This allows the sheet caught between the pressure roller 66 and the heating roller 64 due to paper jam or the like to be removed in the present exemplary embodiment.

Here, in the present exemplary embodiment, the heating roller 64 and the pressure roller 66 are rotated while the pressure roller 66 is pressed against the heating roller 64, and the sheet onto which a toner image has been transferred is fed into a nip where the heating roller 64 and the pressure roller 66 are in contact with each other. Thus, the toner image on the sheet is heated and subjected to pressure, thereby the toner image is fixed onto the sheet.

Figure 2:
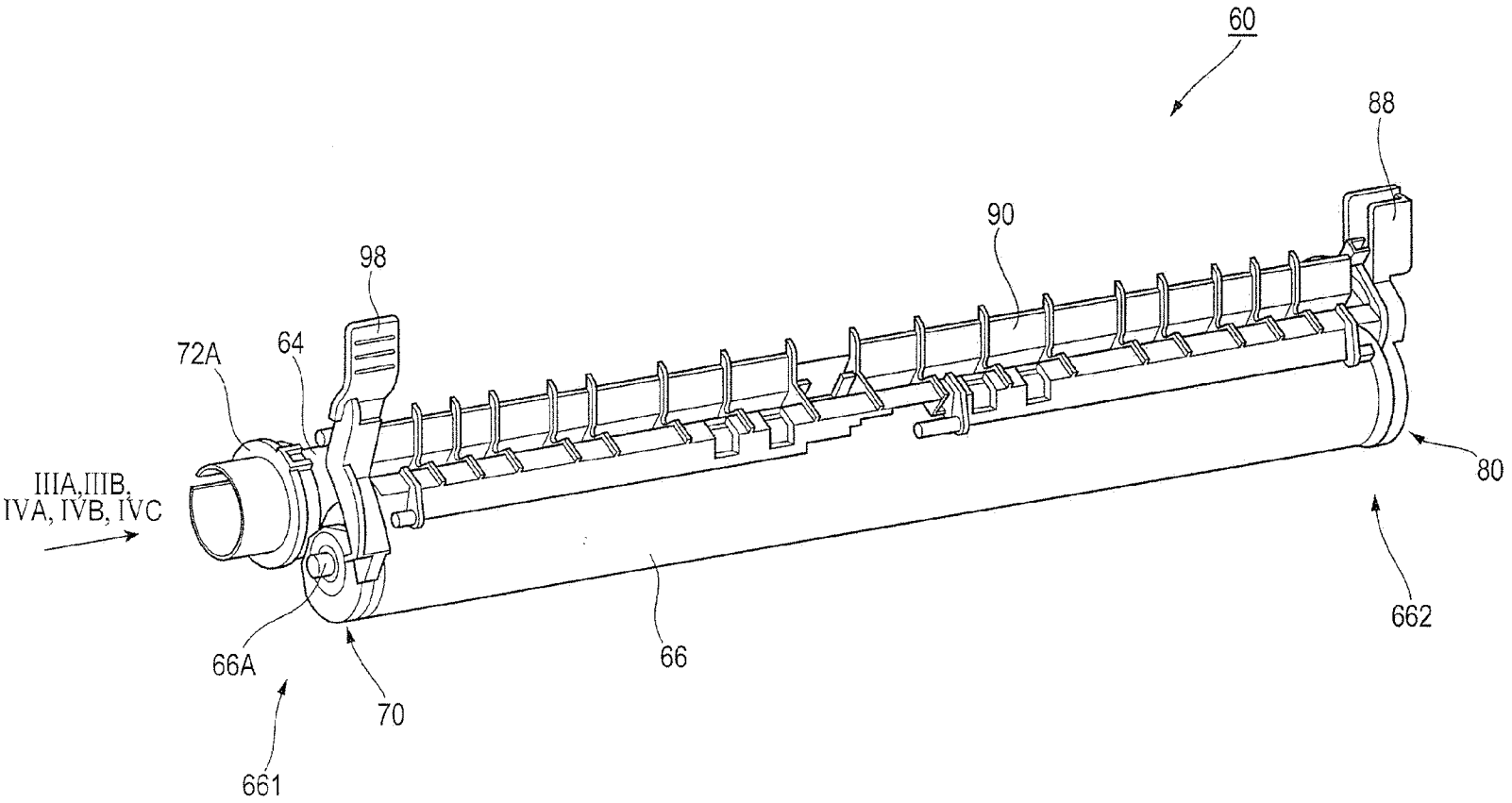
FIG. 2 is a perspective view of a fixing device seen in an arrow II direction in FIG. 1.

FIG. 2 is a perspective view of the fixing device 60 seen in an arrow II direction in FIG. 1.

As illustrated in FIG. 2, in the present exemplary embodiment, a first cam 70 is attached to one end portion 661 of the pressure roller 66 in the axial direction of the pressure roller 66. More specifically, the first cam 70 is attached to the pressure roller 66 such that the first cam 70 is rotatable in the circumferential direction of the pressure roller 66. In more detail, the first cam 70 is attached to a shaft portion 66A of the pressure roller 66, which outwardly projects in the axial direction. Here, the first cam 70 causes the one end portion 661 side of the pressure roller 66 to move in a direction in which the one end portion 661 side is separated from the heating roller 64.

A second cam 80 is attached to another end portion 662 of the pressure roller 66 in the axial direction of the pressure roller 66. Similarly to the first cam 70, the second cam 80 is attached to the other end portion 662 of the pressure roller 66 such that the second cam 80 is rotatable in the circumferential direction of the pressure roller 66. Specifically, the second cam 80 is attached to a shaft portion (not illustrated) of the pressure roller 66, which outwardly projects in the axial direction of the pressure roller 66. The second cam 80 causes the other end portion 662 side of the pressure roller 66 to move in a direction in which the other end portion 662 is separated from the heating roller 64.

Furthermore, in the present exemplary embodiment, a connecting member 90 is provided. The connecting member 90 is connected to the first cam 70 on the one end portion 661 side of the pressure roller 66 and extends from a portion thereof connected to the first cam 70 as a start point toward the other end portion 662 side of the pressure roller 66. Additionally, the connecting member 90 extends in the axial direction of the pressure roller 66 so as to connect the first cam 70 and the second cam 80 to each other.

Cam followers 72A and 72B are provided at one and the other end portions of the heating roller 64 in the axial direction of the heating roller 64. Here, the first cam 70 is pressed against the cam follower 72A provided on the one end portion side of the heating roller 64. The second cam 80 is pressed against the cam follower 72B (not illustrated) provided on the other end portion side of the heating roller 64. The cam followers 72A and 72B each have an annular shape and radially outwardly extend beyond the heating roller 64.

Figure 3B:
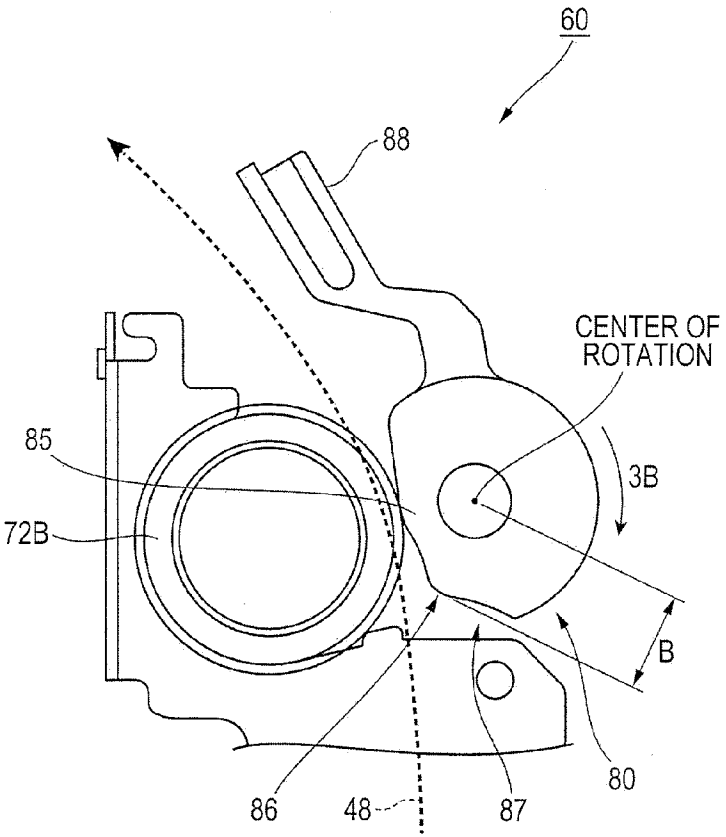
FIGS. 3A and 3B are views of a first cam and a second cam seen in an arrow IIIA direction and an arrow IIIB direction, respectively, in FIG. 2.
Figure 3A:
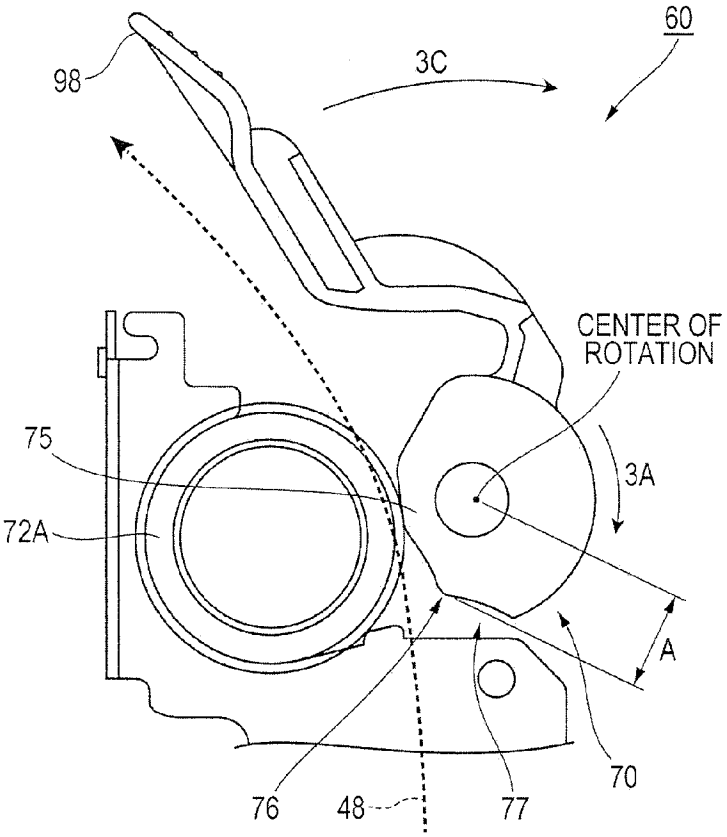

FIGS. 3A and 3B are views of the first cam 70 and the second cam 80 seen in an arrow IIIA direction and an arrow IIIB direction, respectively, in FIG. 2. Specifically, FIG. 3A illustrates the first cam 70 seen in the arrow IIIA direction in FIG. 2, and FIG. 3B illustrates the second cam 80 seen in the arrow IIIB direction in FIG. 2.

Here, FIGS. 3A and 3B illustrate states of the first cam 70 and the second cam 80 before the first cam 70 and the second cam 80 are rotated, that is, before the pressure roller 66 is separated from the heating roller 64. By rotating the first cam 70 and the second cam 80 from these states respectively in an arrow 3A direction (clockwise) and an arrow 3B direction (clockwise), the pressure roller 66 is separated from the heating roller 64.

As illustrated in FIG. 3A, the first cam 70 has a pressure contact portion 75 on an outer circumferential surface thereof. The pressure contact portion 75 is pressed against the cam follower 72A. The first cam 70 also has a projecting portion 76 on the upstream side of the pressure contact portion 75 on the outer circumferential surface thereof in the rotational direction thereof. The first cam 70 also has a recess portion 77 on the upstream side of the projecting portion 76 on the outer circumferential surface thereof in the rotational direction thereof.

In the present exemplary embodiment, the distance between the center of rotation of the first cam 70 and the pressure contact portion 75, the distance between the center of rotation of the first cam 70 and the projecting portion 76, and the distance between the center of rotation of the first cam 70 and the recess portion 77 are different from one another. The distance between the center of rotation of the first cam 70 and (a top portion of) the projecting portion 76 and the distance between the center of rotation of the first cam 70 and (a bottom portion of) the recess portion 77 are greater than the distance between the center of rotation of the first cam 70 and (an outer surface of) the pressure contact portion 75.

Furthermore, in the present exemplary embodiment, the distance between the center of rotation of the first cam 70 and the top portion of the projecting portion 76 is set to distance A.

Here, in order to separate the pressure roller 66 from the heating roller 64, the first cam 70 is rotated in the arrow 3A direction. This causes the projecting portion 76 to face the heating roller 64 side, thereby the projecting portion 76 presses the cam follower 72A. Thus, the one end portion 661 side of the pressure roller 66 (see FIG. 2) resists urging forces applied thereto by the spring members 68 (see FIG. 1) and is moved in the direction in which the one end portion 661 is separated from the heating roller 64.

In the present exemplary embodiment, the first cam 70 is further rotated until the cam follower 72A is finally received in the recess portion 77. Then, rotation of the first cam 70 is stopped.

Next, the second cam 80 is described with reference to FIG. 3B.

Similarly to or the same as the case of the first cam 70, the second cam 80 has a pressure contact portion 85 and a projecting portion 86. The pressure contact portion 85 is pressed against the cam follower 72B. The projecting portion 86 is located upstream of the pressure contact portion 85 in the rotational direction of the second cam 80. The second cam 80 also has a recess portion 87 located further to the upstream side than the projecting portion 86.

Similarly to or the same as the case of the first cam 70, the distance between the center of rotation of the second cam 80 and the pressure contact portion 85, the distance between the center of rotation of the second cam 80 and the projecting portion 86, and the distance between the center of rotation of the second cam 80 and the recess portion 87 are different from one another. The distance between the center of rotation of the second cam 80 and (a top portion of) the projecting portion 86 and the distance between the center of rotation of the second cam 80 and (a bottom portion of) the recess portion 87 are greater than the distance between the center of rotation of the second cam 80 and (an outer surface of) the pressure contact portion 85.

Furthermore, in the present exemplary embodiment, the distance between the center of rotation of the second cam 80 and the top portion of the projecting portion 86 is set to distance B.

Here, in order to separate the pressure roller 66 from the heating roller 64, similarly to or the same as the case on the first cam 70 side, the second cam 80 is rotated in the arrow 3B direction in FIG. 3B. This causes the projecting portion 86 to face the heating roller 64 side, thereby the projecting portion 86 presses the cam follower 72B. Thus, the other end portion 662 side of the pressure roller 66 (see FIG. 2) resists the urging forces applied thereto by the spring members 68 (see FIG. 1) and is moved in the direction in which the other end portion 662 is separated from the heating roller 64. After that, the second cam 80 is further rotated until the cam follower 72B is finally received in the recess portion 87.

Although it is omitted from the above description, the first cam 70 according to the present exemplary embodiment is rotated by a movement of an operating lever 98 attached to the first cam 70 (see FIG. 3A) in an arrow 3C direction in FIG. 3A performed by the user. The operating lever 98 serves as an example of an operating unit. Here, the operating lever 98 outwardly extends in the radial direction of the first cam 70 from the outer circumferential surface of the first cam 70. Furthermore, the operating lever 98 is integrally formed with the first cam 70. Although it is also omitted from the above description, the image forming apparatus 10 according to the present exemplary embodiment includes an outer covering FC as illustrated in FIG. 1. The outer covering FC functions as an openable unit. In the present exemplary embodiment, by opening this outer covering FC, the operating lever 98 is exposed, thereby the user is allowed to operate the operating lever 98.

Furthermore, in the present exemplary embodiment, as illustrated in FIG. 2, the connecting member 90 that connects the first cam 70 and the second cam 80 to each other is provided. In the present exemplary embodiment, when the first cam 70 is rotated (rotated in the arrow 3A direction in FIG. 3A), the connecting member 90, which is interlocked with the first cam 70, is started to be moved as the first cam 70 is rotated. In the present invention, the second cam 80 receives a drive force from the connecting member 90 that is being moved, and accordingly, the second cam 80 is also rotated in the same direction as that of the first cam 70.

Here, as illustrated in FIG. 2, one end of the connecting member 90 in the longitudinal direction is secured to a base portion of the operating lever 98. The other end portion of the connecting member 90 in the longitudinal direction is secured to the second cam 80. More specifically, as illustrated in FIG. 2, the second cam 80 is provided with a projecting member 88 that projects from an outer circumferential surface of the second cam 80 in the radial direction of the second cam 80. The other end portion of the connecting member 90 in the longitudinal direction is secured to this projecting member 88.

In the present exemplary embodiment, broken lines illustrated in FIGS. 3A and 3B represent the sheet passage 48. The connecting member 90 (see FIG. 2) is disposed along the sheet passage 48 so as to guide the sheet passing through the sheet passage 48.

Here, in the present exemplary embodiment, as has been described, the first cam 70, to which the operating lever 98 is attached, is rotated by user operation performed on the operating lever 98. Furthermore, when the operating lever 98 is operated, the connecting member 90, which is interlocked with the operating lever 98, is moved as the operating lever 98 is operated, thereby rotating the second cam 80.

Figures 4A, 4B, 4C:
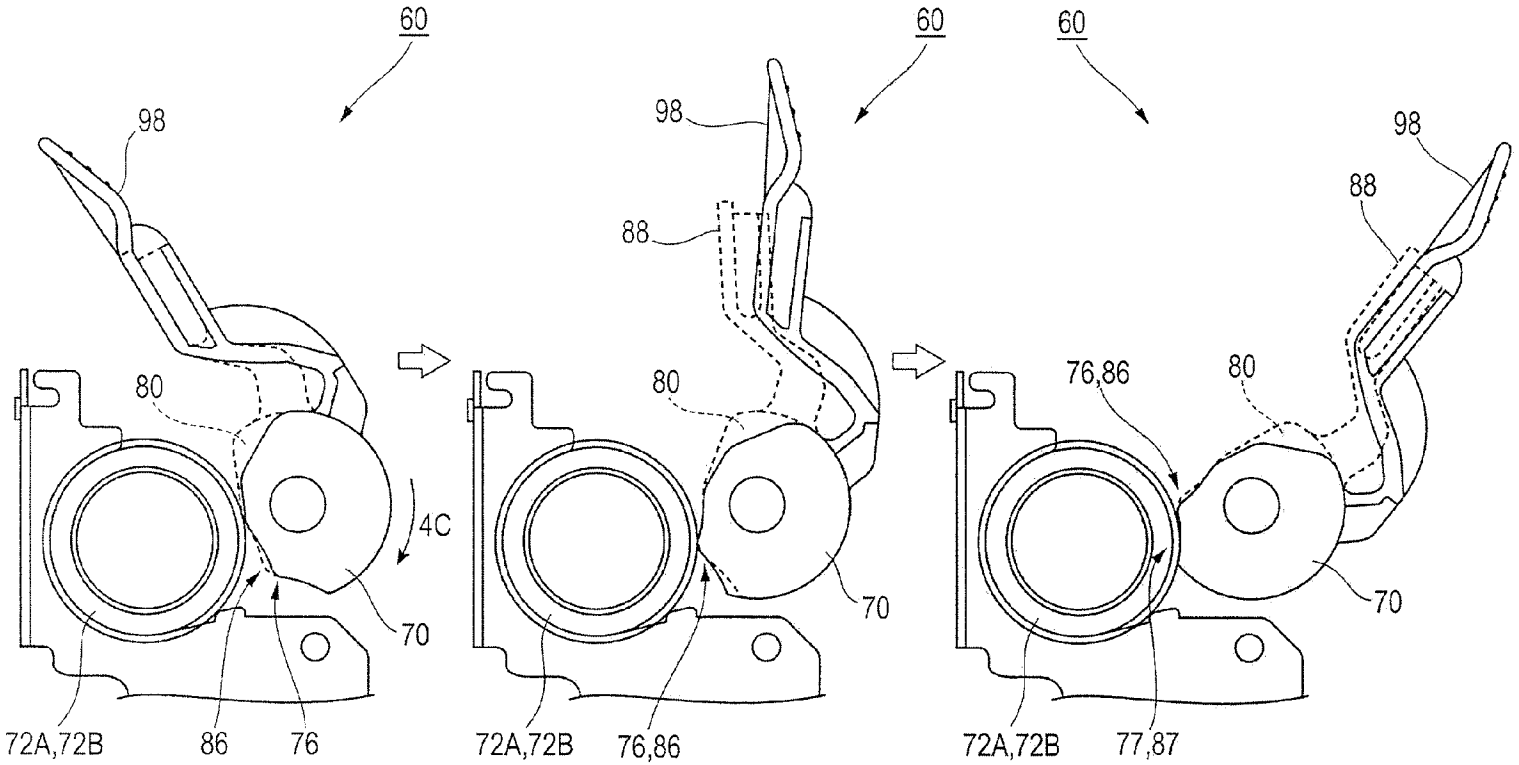
FIGS. 4A to 4C illustrate movements of the first cam and the second cam.

FIGS. 4A to 4C illustrate movements of the first cam 70 and the second cam 80. FIGS. 4A to 4C illustrate states of the fixing device 60 seen in arrow IVA to IVC directions in FIG. 2.

FIG. 4A illustrates a state of the first cam 70 and the second cam 80 before operation of the operating lever 98 is started. Additionally, FIG. 4A illustrates the state of the first cam 70 and the second cam 80 before the first cam 70 and the second cam 80 are rotated.

Although it is omitted in the description with reference to FIGS. 3A and 3B, in the present exemplary embodiment, as illustrated in FIG. 4A, the position of the projecting portion 76 provided in the first cam 70 and the position of the projecting portion 86 provided in the second cam 80 are different from each other. More specifically, in the rotational direction of the first cam 70 and the second cam 80 (direction indicated by arrow 4C in FIG. 4A), the projecting portion 86 of the second cam 80 is positioned downstream of the projecting portion 76 of the first cam 70.

In the present exemplary embodiment, the operating lever 98 is operated from this state.

When the operating lever 98 is started to be operated, rotational drive forces are applied to the first cam 70 and the second cam 80. This causes the first cam 70 and the second cam 80 to be rotated in the arrow 4C direction in FIG. 4A. At this time, the first cam 70 and the second cam 80 are rotated while the states of phases illustrated in FIG. 4A are maintained (while a state in which the projecting portion 86 of the second cam 80 is positioned downstream of the projecting portion 76 of the first cam 70 is maintained).

After that, in the present exemplary embodiment, the projecting portion 86 of the second cam 80 reaches the cam follower 72B of the heating roller 64, and then the projecting portion 76 of the first cam 70 reaches the cam follower 72A of the heating roller 64. Thus, the fixing device 60 is set in a state illustrated in FIG. 4B.

After that, in the present exemplary embodiment, user operation is further performed on the operating lever 98. Thus, the cam followers 72A and 72B are pressed by the projecting portions 76 and 86 of the first and second cams 70 and 80.

In the present exemplary embodiment, when the cam followers 72A and 72B are pressed by the projecting portions 76 and 86, the cam follower 72A and the cam follower 72B are simultaneously pressed by the projecting portion 76 and the projecting portion 86, respectively, as illustrated in FIG. 4B.

After that, in the present exemplary embodiment, as illustrated in FIG. 4C, the cam followers 72A and 72B slide over the projecting portions 76 and 86, and then the cam followers 72A and 72B are received in the recess portions 77 and 87 provided in the first and second cams 70 and 80, respectively.

The connecting member 90 (see FIG. 2) according to the present exemplary embodiment is formed of a thin plate member and easily deformed. Thus, it is not easy to transfer an operating force of the user from the first cam 70 to the second cam 80. In this case, the amount of rotation of the second cam 80 is reduced relative to that of the first cam 70. This may cause problems in that, for example, the projecting portion 86 of the second cam 80 does not reach a position where the projecting portion 86 faces the cam follower 72B. In particular, when the spring forces of the spring members 68 (see FIG. 1) are set to large values, it is likely that the amount of deformation of the connecting member 90 increases and the amount of rotation of the second cam 80 reduces.

Accordingly, in the present exemplary embodiment, in order to cause the projecting portion 86 of the second cam 80 to be moved to the position where the projecting portion 86 faces the cam follower 72B even when the amount of rotation of the second cam 80 is reduced, the projecting portion 86 of the second cam 80 is positioned downstream of the projecting portion 76 of the first cam 70 in a rotational direction of the first and second cams 70 and 80 as described above. Additionally, in the rotational direction of the first and second cams 70 and 80, the projecting portion 86 of the second cam 80 is positioned ahead of the projecting portion 76 of the first cam 70.

In this case, the projecting portion 86 of the second cam 80 reaches the position where the projecting portion 86 faces the cam follower 72B at a stage where the second cam 80 is rotated by a small amount of the rotation. Thus, the cam follower 72B may be more reliably pressed by the projecting portion 86 of the second cam 80 than with a structure in which the position of the projecting portion 76 of the first cam 70 is aligned with the position of the projecting portion 86 of the second cam 80.

Figure 5:
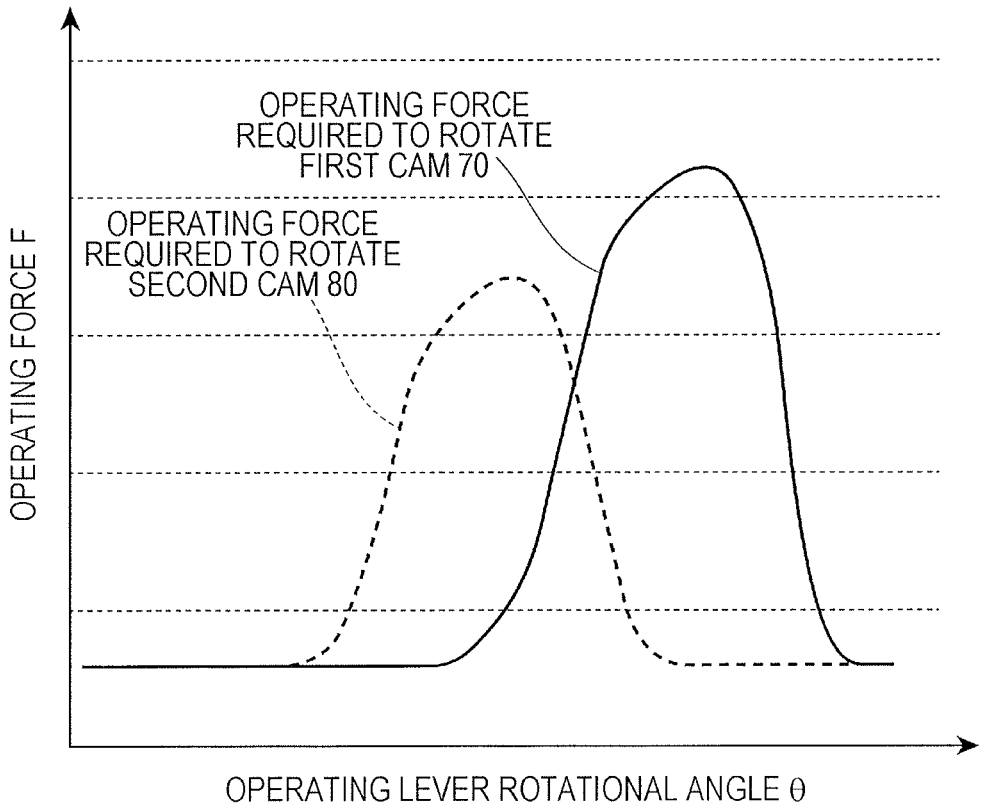
FIG. 5 illustrates an operating force required to operate an operating lever.

FIG. 5 illustrates an operating force F required to operate the operating lever 98 relative to an operating lever rotational angle θ.

In the above description, an example of the case is described in which the cam follower 72A and the cam follower 72B are simultaneously pressed by the projecting portion 76 and the projecting portion 86, respectively, as illustrated in FIG. 4B. Since the cam followers 72A and 72B simultaneously slide over the two projecting portions 76 and 86 in this case, the operating force required to operate the operating lever 98 tends to increase.

FIG. 5 illustrates the operating force required to operate the operating lever 98 in the case where timing at which the cam follower 72A is pressed by the projecting portion 76 and timing at which the cam follower 72B is pressed by the projecting portion 86 are shifted from each other.

Specifically, the operating force required to operate the operating lever 98 in the following case is illustrated: that is, the cam follower 72B is initially pressed by the projecting portion 86 of the second cam 80, and then the cam follower 72A is pressed by the projecting portion 76 of the first cam 70.

In this case, compared to the above-described structure in which the cam follower 72A and the cam follower 72B are simultaneously pressed by the projecting portion 76 and the projecting portion 86, respectively, an operating load (maximum operating load) required to operate the operating lever 98 may be reduced.

In order to cause the timing at which the cam follower 72A is pressed by the projecting portion 76 of the first cam 70 and the timing at which the cam follower 72B is pressed by the projecting portion 86 of the second cam 80 to be different from each other, for example, stiffness of the connecting member 90 (see FIG. 2) is increased so as to suppress deformation of the connecting member 90. In this case, the state illustrated in FIG. 4B (a state in which the projecting portion 76 of the first cam 70 catches up with the leading projecting portion 86 of the second cam 80) does not occur, and accordingly, the projecting portion 86 of the second cam 80 presses the cam follower 72B before the projecting portion 76 of the first cam 70 presses the cam follower 72A.

Also, in order to cause the timing at which the cam follower 72A is pressed by the projecting portion 76 of the first cam 70 and the timing at which the cam follower 72B is pressed by the projecting portion 86 of the second cam 80 to be different from each other, the amount by which the positions of the projecting portion 86 of the second cam 80 and the projecting portion 76 of the first cam 70 are shifted from each other may be increased.

Specifically, the amount by which the projecting portion 76 of the first cam 70 and the projecting portion 86 of the second cam 80 are separated from each other is set to be larger than that in the state illustrated in FIG. 4A. Also in this case, the state in which the projecting portion 76 of the first cam 70 catches up with the leading projecting portion 86 of the second cam 80 is unlikely to occur, and accordingly, the cam follower 72B is pressed by the projecting portion 86 of the second cam 80 before the cam follower 72A is pressed by the projecting portion 76 of the first cam 70.

Furthermore, in the example of the structure illustrated in FIG. 5, in order to increase reliability with which the cam follower 72B is pressed by the projecting portion 86 of the second cam 80, the distance between the center of rotation of the second cam 80 and the top portion of the projecting portion 86 of the second cam 80 is set to be smaller than the distance between the center of rotation of the first cam 70 and the top portion of the projecting portion 76 of the first cam 70.

More specifically, the distance B illustrated in FIG. 3B is set to be smaller than the distance A illustrated in FIG. 3A. In this case, the projecting portion 86 of the second cam 80 may more easily face the cam follower 72B, and accordingly, the cam follower 72B may be more reliably pressed by the projecting portion 86 of the second cam 80 than in the case where the distance A and the distance B are the same.

Other Operations and Variants

In the above description, operations of the components to separate the pressure roller 66 from the heating roller 64 are described. In contrast, in order to bring the pressure roller 66 having been separated from the heating roller 64 into contact with the heating roller 64 again, the operating lever 98 is moved in a direction opposite to the above-described direction of operation. By doing this, operations reverse to the above-description are performed, so that the pressure contact portion 75 of the first cam 70 and the pressure contact portion 85 of the second cam 80 respectively face the cam followers 72A and 72B again.

Furthermore, although the example in which the image forming apparatus 10 that forms a monochrome image has been described, the image forming apparatus 10 is not limited to this. The above-described fixing device 60 may be installed in the image forming apparatus 10 that forms a color image. In the present exemplary embodiment, the image forming apparatus 10 that directly transfers a toner image from the photoconductor drum 32 onto the sheet is described. Alternatively, the image forming apparatus 10 may once transfer the toner image onto an intermediate transfer body such as an intermediate transfer belt and then transfer the toner image from the intermediate transfer body onto the sheet.

In the present exemplary embodiment, the example in which two members that perform fixing are formed of roller-shaped members such as the heating roller 64 and the pressure roller 66 is described. Alternatively, either or both of the two members may be formed of, for example, a belt-shaped member or belt-shaped members, or formed of, for example, a pad-shaped member or pad-shaped members. Also in the present exemplary embodiment, the example of the structure in which the connecting member 90 has a sheet guiding function is described. Alternatively, a sheet guiding member separated from the connecting member 90 may be provided.

Also in the present exemplary embodiment, the example of the case where the first cam 70 is rotated by the operating force from the user is described. Alternatively, the first cam 70 may be rotated by a drive source such as a motor.

Furthermore, the term "separate" referred to in the present exemplary embodiment regarding the pressure roller 66 and the heating roller 64 does not necessarily describe a form in which the pressure roller 66 is entirely separated from the heating roller 64. In the present exemplary embodiment, the term "separate" also describes forms including a form in which the pressure roller 66 and the heating roller 64 are partly in contact with each other.

More specifically, for example, to "separate" refers to forms including the following form: that is, the pressure roller 66 and the heating roller 64 are separated from each other on the one end portion 661 (see FIG. 2) side of the pressure roller 66 and the pressure roller 66 and the heating roller 64 are in contact with each other at a reduced pressure on the other end portion 662 side of the pressure roller 66.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member used to fix an image onto a recording medium;

a pressure member having one end portion and another end portion in an axial direction thereof, the pressure member being rotatably provided, the pressure member being pressed against the fixing member so as to apply a pressure to the recording medium;

a first cam having an outer circumferential surface and a projecting portion provided on the outer circumferential surface of the first cam, the first cam being attached to the one end portion of the pressure member, the first cam being rotatable in a circumferential direction of the pressure member, the first cam being rotated in one direction so as to cause the projecting portion thereof to apply a pressure toward the fixing member, thereby causing the one end portion side of the pressure member to move in a direction in which the one end portion side of the pressure member is separated from the fixing member;

a connecting member connected to the first cam on the one end portion side of the pressure member, the connecting member extending toward the other end portion side of the pressure member; and a second cam having an outer circumferential surface and a projecting portion provided on the outer circumferential surface of the second cam, the second cam being attached to the other end portion of the pressure member, the connecting member being connected to the second cam, the second cam being rotatable in the circumferential direction of the pressure member, the second cam being rotated in the one direction by receiving a drive force from the connecting member, which is interlocked with the first cam rotated in the one direction, so as to cause the projecting portion thereof to apply a pressure toward the fixing member, thereby causing the other end portion side of the pressure member to move in a direction in which the other end portion side of the pressure member is separated from the fixing member, wherein, before the first cam and the second cam are rotated in the one direction, the projecting portion of the second cam is positioned downstream of the projecting portion of the first cam in the one direction.

2. The fixing device according to claim 1, wherein, when the first cam is started to be rotated in the one direction, the projecting portion of the second cam initially applies the pressure toward the fixing member, and then, the projecting portion of the first cam applies the pressure toward the fixing member.

3. The fixing device according to claim 1, wherein the first cam has a center of rotation and the projecting portion of the first cam has a top portion, and the second cam has a center of rotation and the projecting portion of the second cam has a top portion, and wherein, a distance between the center of rotation of the second cam and the top portion of the projecting portion of the second cam is less than a distance between the center of rotation of the first cam and the top portion of the projecting portion of the first cam.

4. The fixing device according to claim 1, wherein a recording medium passage, through which the recording medium passes, extends through the fixing device, and wherein the connecting member is disposed along the recording medium passage, so that the connecting member has a function of guiding the recording medium passing through the recording medium passage.

5. An image forming apparatus comprising:

an image forming section that forms an image on a recording medium; and a fixing device that fixes onto the recording medium the image on the recording medium formed by the image forming section, the fixing device including a fixing member used to fix the image onto the recording medium, a pressure member having one end portion and another end portion in an axial direction thereof, the pressure member being rotatably provided, the pressure member being pressed against the fixing member so as to apply a pressure to the recording medium, a first cam having an outer circumferential surface and a projecting portion provided on the outer circumferential surface of the first cam, the first cam being attached to the one end portion of the pressure member, the first cam being rotatable in a circumferential direction of the pressure member, the first cam being rotated in one direction so as to cause the projecting portion thereof to apply a pressure toward the fixing member, thereby causing the one end portion side of the pressure member to move in a direction in which the one end portion side of the pressure member is separated from the fixing member, a connecting member connected to the first cam on the one end portion side of the pressure member, the connecting member extending toward the other end portion side of the pressure member, and a second cam having an outer circumferential surface and a projecting portion provided on the outer circumferential surface of the second cam, the second cam being attached to the other end portion of the pressure member, the connecting member being connected to the second cam, the second cam being rotatable in the circumferential direction of the pressure member, the second cam being rotated in the one direction by receiving a drive force from the connecting member, which is interlocked with the first cam rotated in the one direction, so as to cause the projecting portion thereof to apply a pressure toward the fixing member, thereby causing the other end portion side of the pressure member to move in a direction in which the other end portion side of the pressure member is separated from the fixing member, wherein, before the first cam and the second cam are rotated in the one direction, the projecting portion of the second cam is positioned downstream of the projecting portion of the first cam in the one direction.

6. The image forming apparatus according to claim 5, further comprising:

an operating unit provided on the one end portion side in the axial direction of the pressure member, the operating unit being operated by a user to rotate the first cam and the second cam; and an openable unit openably provided, the openable unit causing the operating unit to be exposed so as to allow the user to operate the operating unit.

* * * * *